US005757366A

United States Patent [19]

Suzuki

[11] Patent Number: 5,757,366

[45] Date of Patent: May 26, 1998

[54] STATE INDICATION CIRCUIT FOR A DISPLAY SYSTEM

[75] Inventor: Yasuhiro Suzuki, Tokyo, Japan

[73] Assignee: NEC Corporation, Tokyo, Japan

[21] Appl. No.: 618,864

[22] Filed: Mar. 20, 1996

[30] Foreign Application Priority Data

Mar. 22, 1995 [JP] Japan ..... 7-062841

[51] Int. Cl.[6] ..... G04G 5/00

[52] U.S. Cl. ..... 345/213; 345/13; 345/211; 345/212; 348/500; 348/536

[58] Field of Search ..... 345/13, 14, 211, 345/212, 213; 348/500, 536, 540, 547

[56] References Cited

U.S. PATENT DOCUMENTS

| | | | |
|---|---|---|---|
| 5,029,284 | 7/1991 | Utsumi et al. | 345/213 |
| 5,031,118 | 7/1991 | Morizot | 345/213 |
| 5,298,920 | 3/1994 | Shindo | 345/213 |
| 5,394,171 | 2/1995 | Rabii | 345/213 |
| 5,635,960 | 6/1997 | Onagawa | 345/213 |

FOREIGN PATENT DOCUMENTS 4-75092 3/1992 Japan .

*Primary Examiner*—Richard Hjerpe
*Assistant Examiner*—Kent Chang
*Attorney, Agent, or Firm*—Laff, Whitesel, Conte & Saret, Ltd.

[57] ABSTRACT

A horizontal synchronizing signal Hs and a vertical synchronizing signal Vs are converted to digital data, respectively, by corresponding frequency-to-voltage conversion circuits 10 and 20 and AD conversion circuits 30 and 40. These digital data are compared with regulation values corresponding to the operation frequencies of a CRT display 2000 stored in the regulation value memory 90 by a frequency decision circuit 50 so that abnormality of frequency of the horizontal synchronizing signal and vertical synchronizing signal is decided. At an abnormal time, the state indication data corresponding to the abnormal state are read out from the state indication data memory 70. The display control circuit 60 constitutes a new video signal based on the state indication data and supplies the new signal to the CRT display in place of the video signal from the computer 1000 through the switch 80.

2 Claims, 4 Drawing Sheets

STATE INDICATION CIRCUIT FOR A DISPLAY SYSTEM

BACKGROUND OF THE INVENTION

The present invention relates to a state indication circuit, and more particularly, to a state indication circuit for a display system comprised of a computer body and a CRT display connected to the computer body.

In general, in a computer system, there is a case where a display device such as a CRT is set near a host system, and a case where the display device together with an operation unit such as a keyboard is set at a place remote from the host system in accordance with setting environment, using conditions and the like.

In the former case, since the display device is set near the host system, it is easy to confirm the connection state of an image interface of the CRT display device, and if a power supply is taken from a service outlet of the host system, the power supply can be switched on and off concurrently with the host system.

In the latter case, although the connection of the image interface must be made by an extension cable or the like, it is very often that the power supply is separately provided. On the other hand, when the number of peripheral devices connected to the host system becomes large, the power supply must be separately provided, so that even in the former case, it becomes impossible to switch on and off the power supply concurrently with the host system. Accordingly, the CRT display device is generally equipped with an intrinsic power switch.

In the display system mentioned above, there is a problem that it is impossible to quickly decide the cause of trouble for a non-display state of the CRT display device which may be caused by the breaking of the image interface cable, incompleteness of cable setting, or trouble of a display control circuit in the host system.

Japanese Patent Unexamined Publication No. Hei. 4-75092 (1992) discloses a technique that partially solves the problem. This prior art discloses that there is available to detect the interruption of vertical/horizontal synchronizing signals of a video signal, and to flickeringly display a red color at the time of the interruption of the synchronizing signals.

This prior art can indicate the trouble generated when the vertical/horizontal synchronizing signals are interrupted by the unconnection of the image interface, the breaking of a wire, switching off the power supply of the host computer, and the like. However, this prior art can not indicate the disturbance of frequency of the vertical/horizontal synchronizing signals as trouble, which is caused by an abnormal operation or the like of the host computer. Further, even if an operator observes the disturbance of an image caused by the disturbance of frequency of the vertical/horizontal synchronizing signals, the operator can not decide whether the disturbance of the image is caused by the abnormality of the display device itself or caused by the abnormality of the host computer side.

SUMMARY OF THE INVENTION

An object of the present invention is to provide a state indication circuit that can indicate not only the trouble due to the interruption of supply of vertical/horizontal synchronizing signals, but also the trouble of image disturbance due to the disturbance of frequency of these signals so that the inspection of trouble can be made extremely easy.

According to one aspect of the invention, there is provided a state indication circuit for a display that operates in a pair of a horizontal synchronizing signal of a frequency Ai (i=1 to N) and a vertical synchronizing signal of a frequency Bi, characterized by comprising first frequency-to-voltage conversion means for converting a frequency of a horizontal synchronizing signal supplied from an outside to a first voltage; second frequency-to-voltage conversion means for converting a frequency of a vertical synchronizing signal supplied from the outside to a second voltage; first analog-to-digital conversion means for converting the first voltage to corresponding first digital data; second analog-to-digital conversion means for converting the second voltage to corresponding second digital data; first memory means for storing digital data DHi and DVi corresponding to the frequencies Ai and Bi, respectively and digital data fi and gi corresponding to allowable variation values allowed for the operation of the CRT display as variation values of the frequencies Ai and Bi; frequency decision means for deciding abnormality of the frequency of the horizontal synchronizing signal corresponding to the first digital data and the frequency of the vertical synchronizing signal corresponding to the second digital data by referring to the data stored in the first memory means, and generating an abnormal signal indicating the abnormality and a read-out signal for reading out state indication data corresponding to abnormal states at an abnormal time; second memory means for storing plural numbers of the state indication data indicating the abnormal states of the frequency of the horizontal synchronizing signal and the frequency of the vertical synchronizing signal, and outputting the state indication data corresponding to the read-out signal; display control means for outputting a video signal composed of horizontal and vertical synchronizing signals for operating the display and the state indication data supplied from the second memory means in response to the abnormal signal; and changing means for supplying a video signal supplied from the outside to the display at a normal time, changing the video signal from the outside to the video signal supplied from the display control means in response to the abnormal signal, and supplying the changed signal to the display.

According to another aspect of the invention, there is provided a state indication circuit for a display which operates in a pair of a horizontal synchronizing signal of a frequency Ai (i=1 to N) and a vertical synchronizing signal of a frequency Bi, characterized by comprising first frequency-to-voltage conversion means for converting a frequency of a horizontal synchronizing signal supplied from an outside to a first voltage; second frequency-to-voltage conversion means for converting a frequency of a vertical synchronizing signal supplied from the outside to a second voltage; first analog-to-digital conversion means for converting the first voltage to corresponding first digital data; second analog-to-digital conversion means for converting the second voltage to corresponding second digital data; first memory means for storing digital data DHi and DVi corresponding to the frequencies Ai and Bi, respectively and digital data fi and gi corresponding to allowable variation values allowed for the operation of the CRT display as variation values of the frequencies Ai and Bi; frequency decision means for deciding abnormality of the frequency of the horizontal synchronizing signal corresponding to the first digital data and the frequency of the vertical synchronizing signal corresponding to the second digital data by referring to the data stored in the first memory means, and generating abnormal signals corresponding to respective abnormal states; and indication means provided for the respective abnormal signals corresponding to the respective abnormal states and for indicating reception of signal in response to the respective abnormal signals.

DESCRIPTION OF THE PREFERRED EMBODIMENTS

Preferred embodiments of the present invention will now be described with reference to the accompanying drawings.

Figure 1:
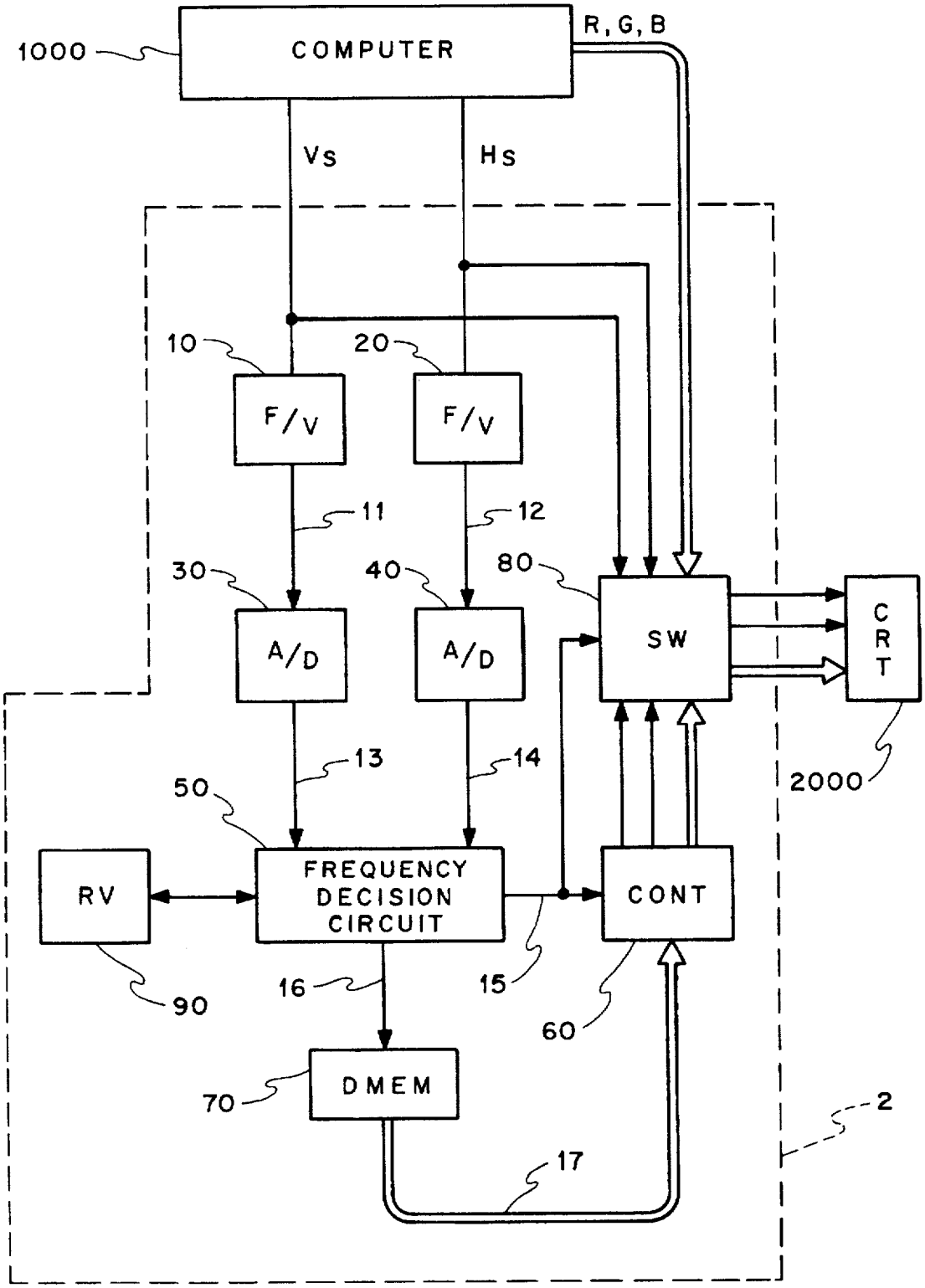
FIG. 1 is a block diagram showing a first embodiment of the invention.

FIG. 1 is a block diagram showing a first embodiment of a state indication circuit of the present invention.

As shown in FIG. 1, the state indication circuit 1 of the first embodiment comprises frequency-to-voltage conversion circuits 10 and 20 for converting the respective frequencies of horizontal synchronizing signal and vertical synchronizing signal supplied from a computer 1000 to corresponding voltages 11 and 12, respectively, and outputting the voltages; AD conversion circuits 30 and 40 for respectively digitizing the voltages 11 and 12, respectively, supplied from the frequency-to-voltage conversion circuit 10 and the frequency-to-voltage conversion circuit 20 to form digital data 13 and 14 of plural bits and outputting the data; regulation value memory (RV) 90 for storing digital data corresponding to central values of horizontal and vertical synchronizing signals, which are operation frequencies of the CRT display 2000, and to an allowable range thereof (data corresponding to the central values being hereinafter referred to as regulation values); frequency decision circuit 50 for comparing the regulation values stored in the regulation value memory 90 with the digital data supplied from the AD conversion circuits 30 and 40, deciding whether or not the horizontal synchronizing signal and the vertical synchronizing signal supplied from the computer 1000 are abnormal as the operation frequency of the CRT display 2000, and, in case of abnormality, generating an abnormal signal 15 showing the abnormality of frequency and a read-out signal 16 for reading out state indication data corresponding to the abnormal state; state indication data memory 70 for storing plural numbers of state indication data and outputting the state indication data 17 corresponding to the read-out signal 16 in response to the read-out signal; display control circuit 60 for generating a video signal including horizontal synchronizing signals and vertical synchronizing signals to the CRT display 2000 in response to the abnormal signal 15 and the state indication data 17; and switch 80 for supplying a video signal from the computer 1000 to the CRT display 2000 at a normal time and changing the video signal from the computer to the video signal from the display control circuit 60 in response to the supply of the abnormal signal 15.

In this embodiment, it is assumed that the CRT display 2000 is a multi-scan type CRT display operating in N pairs of horizontal synchronizing signals and vertical synchronizing signals. Accordingly, the regulation value memory 90 stores, as the regulation values, DHi (i =1 to N) for the horizontal synchronizing signals, DVj (j =1 to N) for the vertical synchronizing signals, and fi and gj as allowable ranges thereof. It is assumed that the CRT display 2000 is operated in the pairs of horizontal synchronizing signals and the vertical synchronizing signals corresponding to the N pairs of regulation values (i =j) and values in the allowable ranges.

As the state indication data stored in the state indication data memory 70, there are prepared three kinds of data, that is, (1) data showing abnormality of the horizontal synchronizing signal, (2) data showing abnormality of the vertical synchronizing signal, and (3) data showing abnormality due to supply of a pair of horizontal synchronizing signal and vertical synchronizing signal corresponding to a value in the allowable range.

Figure 3A:
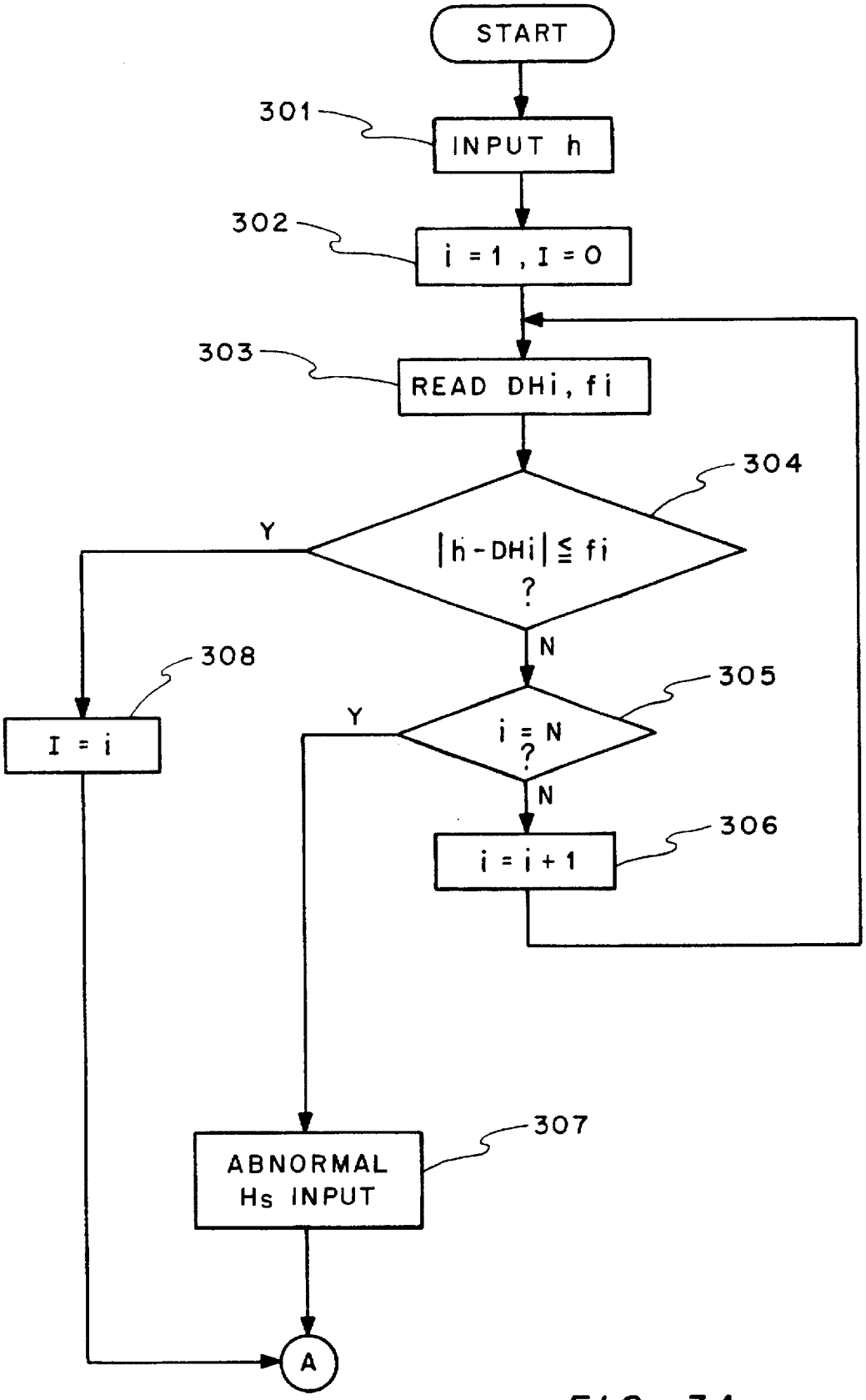
FIG. 3A and 3B are flow charts for explaining an operation of a frequency decision circuit in the first and second embodiments.
Figure 3B:
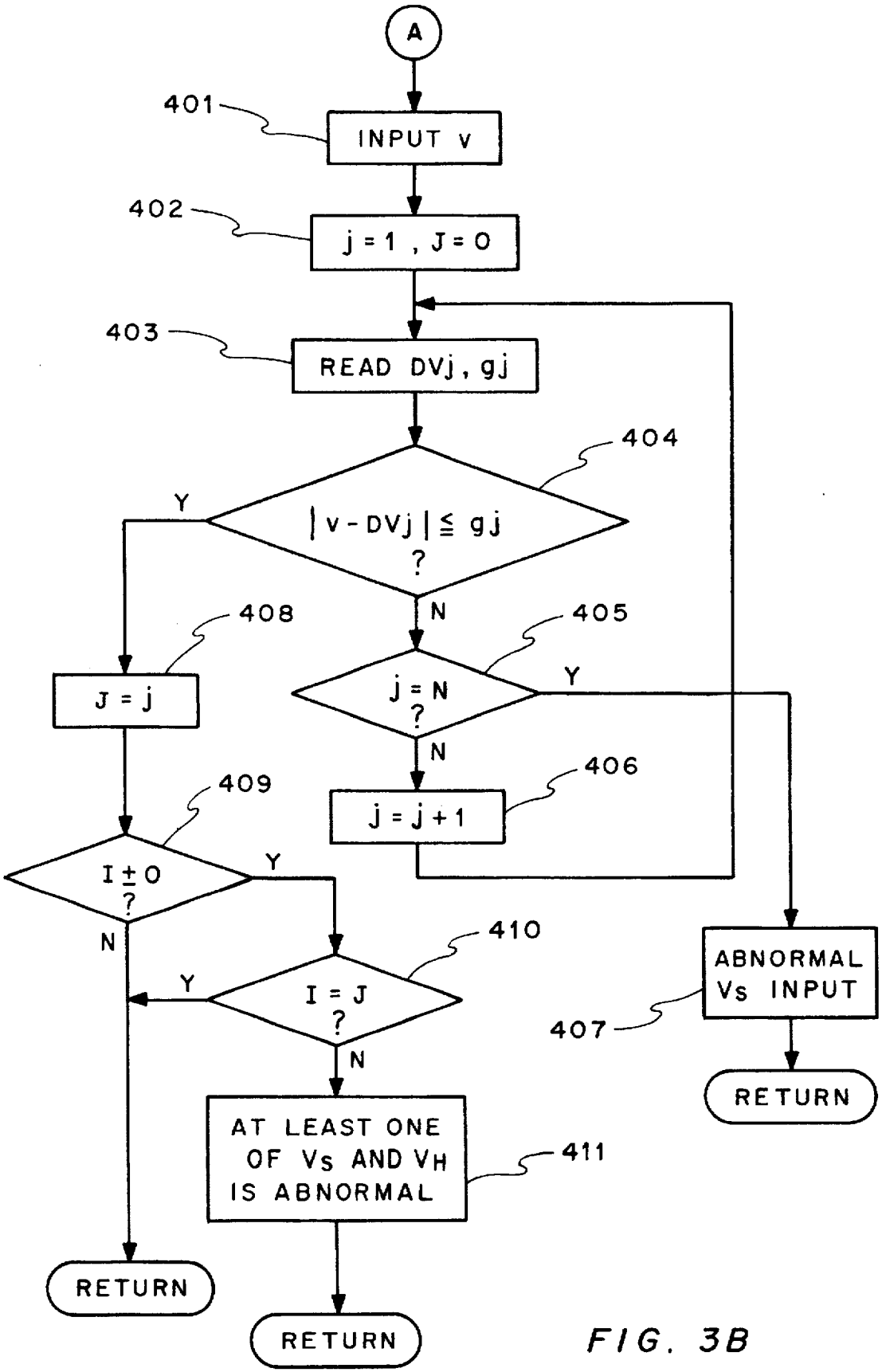

The frequency decision circuit 50 is, for example, constructed by a program-controllable microcomputer, and FIGS. 3A and 3B are flow charts showing the operation. The operation of the state indication circuit of the first embodiment will be described with reference to FIGS. 1, 3A and 3B.

In the normal state in which the computer 1000 supplies normal horizontal synchronizing signals and vertical synchronizing signals and there is no abnormality such as the breaking of a cable supplying the signals, since the frequency decision circuit 50 does not generate the abnormal signal 15, the switch 80 supplies the video signal including the horizontal synchronizing signals and the vertical synchronizing signals supplied from the computer 1000 to the CRT display 2000, whereby the CRT display 2000 performs the normal display operation.

The frequency-to-voltage conversion circuit 10 and the frequency-to-voltage conversion circuit 20 are respectively supplied with the horizontal synchronizing signal Hs and the vertical synchronizing signal Vs from the computer 1000, and the frequency-to-voltage conversion circuit 10 converts the frequency of the input horizontal synchronizing signal to the voltage 11 corresponding thereto to supply the voltage to the AD conversion circuit 30. The frequency-to-voltage conversion circuit 20 converts the frequency of the vertical synchronizing signal to the voltage 12 corresponding thereto to supply the voltage to the AD conversion circuit 40.

The AD conversion circuits 30 and 40 respectively sample and quantize the voltages 11 and 12 supplied from the frequency-to-voltage conversion circuits 10 and 20 to convert the voltages to the digital data 13 and 14 of plural bits and to output the data to the frequency decision circuit 50.

The frequency decision circuit 50 decides whether or not the frequency of the horizontal synchronizing signal and the vertical synchronizing signal supplied from the computer 1000 is abnormal on the basis of the supplied digital data 13 and 14, and in case of abnormality, generates the abnormal signal 15 and the read-out signal 16 for reading out the state indication data corresponding to the abnormal state. The operation of the frequency decision circuit 50 will be described with reference to the flow charts of FIGS. 3A and 3B.

It is assumed that the value of the digital data 13 corresponding to the frequency of the horizontal synchronizing signal supplied from the computer 1000 is h, and the value of the digital data 14 corresponding to the frequency of the vertical synchronizing signal is v.

First, the horizontal synchronizing signal is checked.

The frequency decision circuit 50 is inputted with value H supplied from the AD conversion circuit 30 at step 301. The process from step 303 to step 306 is repeated for the parameter i to read out the regulation values DHi corresponding to the horizontal synchronizing signals and stored in the regulation value memory 90 and the allowable ranges fi thereof, and to check whether the absolute value of difference between the values h and DHi is equal to or less than fi.

If |h−DHi| is equal to or more than the allowable ranges fi for all parameters i, then the frequency of the horizontal synchronizing signal is abnormal so that the operation of the decision circuit 50 proceeds to step 307 to carry out the abnormality management. That is, the abnormal signal 15 is generated and there is generated the first readout signal 16 for reading out the state indication data indicating "the frequency of the horizontal synchronizing signal is abnormal" from the state indication data memory, and then the check of the vertical synchronizing signal described later is performed.

At step 304, if |h−DHi| for some parameter i becomes equal to or less than fi (Y-branch in step 304), it is temporarily decided that the frequency of the horizontal synchronizing signal is not abnormal, and value I of the loop parameter i at that time is stored (step 308).

Next, the check of the vertical synchronizing signal will be described. When the vertical synchronizing signal is checked, the frequency decision circuit 50 is inputted with value v supplied from the AD conversion circuit 40 at step 401. The process from step 403 to 406 is repeated for parameters j to read out the regulation values DVi corresponding to the vertical synchronizing signal stored in the regulation value memory 90 and the allowable ranges gj thereof and to check whether or not |v−DVj| is equal to or less than gj.

If the absolute value of the difference between values v and DVj is larger than gj for all parameters j (N-branch in step 404), then the frequency of the vertical synchronizing signal is abnormal so that the operation of the decision circuit 50 proceeds to step 407 to carry out the abnormality management. That is, the abnormal signal 15 is generated, and there is generated the second read-out signal 16 for reading out the state indication data showing "the frequency of the vertical synchronizing signal is abnormal" from the state indication data memory, whereby the decision operation of frequency is ended.

At step 404, if |v−DVj| for some parameter j becomes equal to or less than gj (Y-branch of step 404), it is temporarily decided that the frequency of the vertical synchronizing signal is not abnormal, and the value J of loop parameter j at that time is stored (step 308), then it is checked whether or not there is the value I stored at step 308 (step 409), and if the value I is not stored (N-branch of step 409), the decision operation of frequency is ended. At the start of operation in FIG. 3, it is assumed that I =0. In this embodiment, it is decided whether or not the abnormality was detected at the check of the horizontal synchronizing signal based on the fact whether this I is 0 or not.

When there is the value I stored at step 308, that is, when I is not 0 (Y-branch of step 409), it is checked whether this value I and the value J stored at step 408 are equal to each other (step 410).

When the value I is equal to the value J at step 410 (Y-branch of step 410), the pairs of the horizontal and vertical synchronizing signals supplied from the computer 1000 are pairs of horizontal synchronizing signals and vertical synchronizing signals usable for operating the CRT display 2000, so that the decision operation of frequency is ended.

If the value I is not equal to the value J at step 410 (N-branch of step 401), then they are not pairs of horizontal synchronizing signals and vertical synchronizing signals usable for operating the CRT display 2000, so that it is decided that at least one of the horizontal synchronizing signal and the vertical synchronizing signal is abnormal, and the abnormality management is carried out (step 407). That is, the abnormal signal 15 is generated and there is generated the third read-out signal 16 for reading out the state indication data showing "at least one of the horizontal synchronizing signal and the vertical synchronizing signal is abnormal" from the state indication data memory, whereby the decision operation of frequency is ended.

Next, the operation in the case where abnormality occurs so that the frequency decision circuit 50 generates the abnormal signal 15 and any one of the first, second and third read-out signals 16, will be described.

The state indication data memory 70 outputs, in response to the respective first, second and third read-out signals 16, the first state indication data showing that the frequency of the horizontal synchronizing signal is abnormal, the second state indication data showing that the frequency of the vertical synchronizing signal is abnormal, and the third state indication data showing that at least one of the horizontal synchronizing signal and the vertical synchronizing signal is abnormal, and supplies the data to the display control circuit 60.

The display control circuit 60 is supplied with the abnormal signal 15 and the state indication data 17 to generate horizontal synchronizing signals and vertical synchronizing signals constituting pairs usable for operating the CRT display 2000 and supply the video signal composed of these pairs and the state indication data to the switch 80.

In response to the abnormal signal 15, the switch 80 changes the video signal supplied from the computer 1000 to the video signal 18 supplied from the display control circuit 60 to supply the signal to the CRT display 2000.

In this way, according to the first embodiment, when abnormality including the shift of frequency as well as the interruption occurs in the synchronizing signals supplied from the computer 1000, in response to this, the abnormal state together with the cause is displayed on the CRT display 2000 by the video signal supplied from the state indication circuit 1 so that the inspection of the trouble can be easily carried out.

A second embodiment of the present invention will next be described with reference to FIG. 2.

Figure 2:
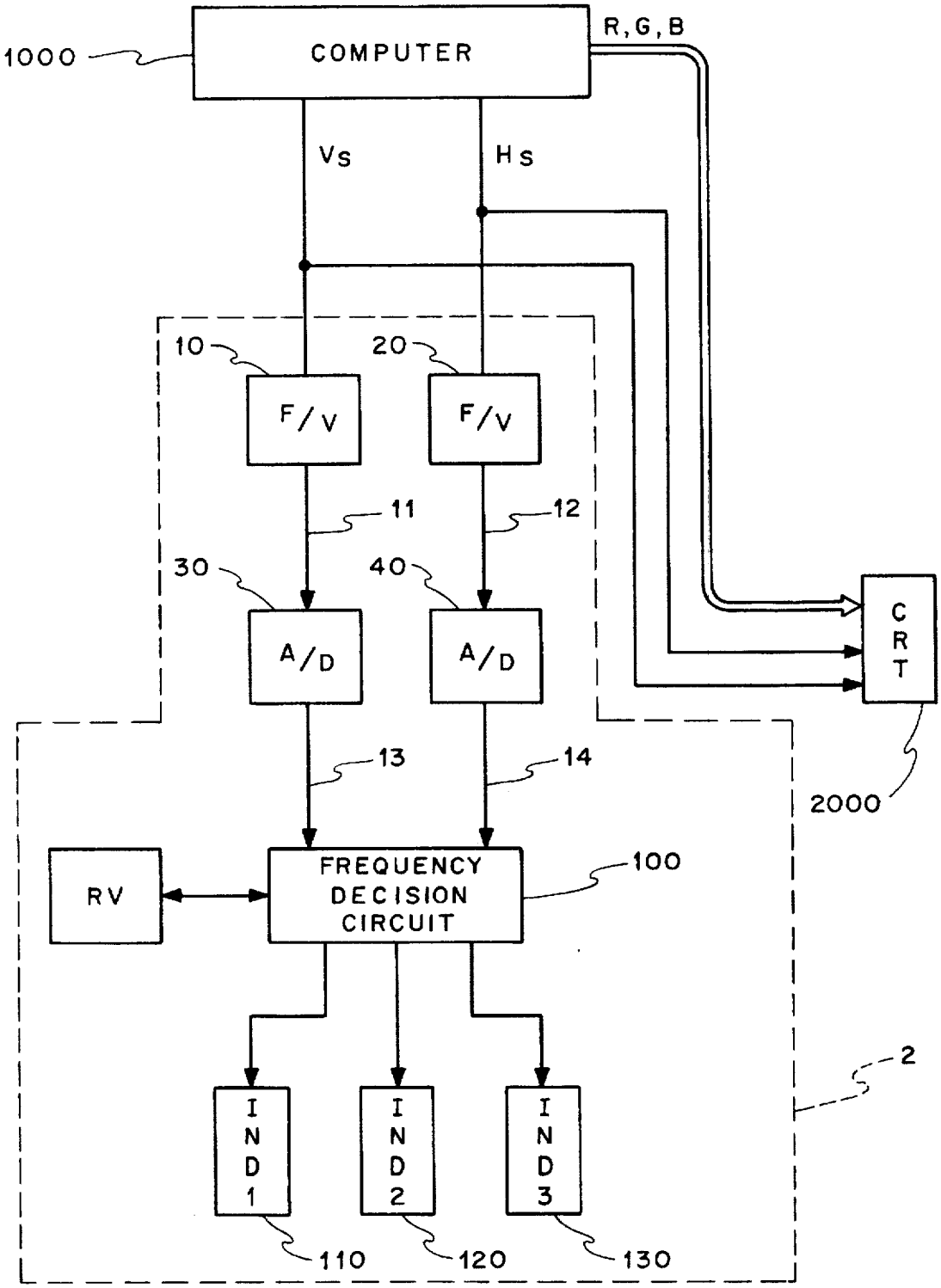
FIG. 2 is a block diagram showing a second embodiment of the invention.

As is apparent from the comparison between FIG. 1 and FIG. 2, the display control circuit 60, the state indication data memory 70 and the switch 80 in the first embodiment are replaced by indication portions 110, 120 and 130 for separately indicating the three abnormal states described in the first embodiment. In this second embodiment, since the state indication at an abnormal time is not carried out on the CRT display 2000, the display control circuit 60, the state indication data memory 70 and the switch 80 of components of the first embodiment can be deleted so that the structure can be made simple.

The operation of the second embodiment will be described with reference to FIGS. 2 and 3.

The operations of the frequency-to-voltage conversion circuit 10, the frequency-to-voltage conversion circuit 20, the AD conversion circuit 30 and the AD conversion circuit 40 until the formation of the digital data H and V corresponding to the horizontal synchronizing signals and the vertical synchronizing signals supplied from the computer 1000, are the same as those in the first embodiment, so that the description thereof will be omitted for avoiding repetition.

Next, the frequency decision operation of a frequency decision circuit 100 carried out by receiving the values h and v and referring to the regulation value memory 90, is also the same as the flow chart of FIG. 3 showing the operation of the first embodiment, so that the description thereof will also be omitted to avoid repetition.

The operation after the frequency decision result is decided to be abnormality will be described. That is, the operation after it is decided that abnormality occurs at step 307, step 407 and step 411 in the flow chart of FIG. 3 will be described.

At step 307, if it is decided that the frequency of the horizontal synchronizing signal is abnormal, the frequency decision circuit 100 generates a first abnormal signal 21 to supply the signal to the indication portion 110, and proceeds to the check operation of the vertical synchronizing signals.

At step 407, if it is decided that the frequency of the vertical synchronizing signal is abnormal, the frequency decision circuit 100 generates a second abnormal signal 22 to supply the signal to the indication portion 120 and ends the frequency decision operation.

At step 411, if it is decided that at least one of the horizontal synchronizing signal and the vertical synchronizing signal is abnormal, the frequency decision circuit 100 generates a third abnormal signal 23 to supply the signal to the indication portion 130 and ends the frequency decision operation.

The indication portion 110 is lit in response to the first abnormal signal 21, the indication portion 120 is lit in response to the second abnormal signal 22, and the indication portion 130 is lit in response to the third abnormal signal 23.

In this way, according to the second embodiment, when abnormality including the shift of frequency as well as the interruption occurs in the synchronizing signal supplied from the computer 1000, in response to this, the state indication circuit 2 indicates the abnormal state through different lighting for each cause so that the inspection of the trouble can be extremely made easy, and the structure can be made simpler than the first embodiment.

In the above description, although the multi-scan type CRT display in which the present invention has noticeable effects, has been used as an example, it is apparent that the present invention is not limited to this but can also be applied to a CRT display operated by only one normal and fixed pair of horizontal and vertical synchronizing signals.

As described above, when abnormality including the shift of frequency as well as the interruption occurs in the synchronizing signal supplied from the computer 1000, in response to this, the state indication circuit of the present invention indicates the abnormal state for each cause so that the inspection of the trouble can be extremely made easy.

What is claimed is:

1. A state indication circuit for a display which operates in a pair of a horizontal synchronizing signal of a frequency Ai (i=1 to N) and a vertical synchronizing signal of a frequency Bi, comprising:

first frequency-to-voltage conversion means for converting a frequency of a horizontal synchronizing signal supplied from an outside to a first voltage;

second frequency-to-voltage conversion means for converting a frequency of a vertical synchronizing signal supplied from the outside to a second voltage;

first analog-to-digital conversion means for converting the first voltage to corresponding first digital data;

second analog-to-digital conversion means for converting the second voltage to corresponding second digital data;

first memory means for storing digital data DHi and DVi corresponding to the frequencies Ai and Bi, respectively and digital data fi and gi corresponding to allowable variation values allowed for the operation of the CRT display as variation values of the frequencies Ai and Bi;

frequency decision means for deciding abnormality of the frequency of the horizontal synchronizing signal corresponding to the first digital data and the frequency of the vertical synchronizing signal corresponding to the second digital data by referring to the data stored in the first memory means, and generating an abnormal signal indicating the abnormality and read-out signals for reading out state indication data corresponding to abnormal states at an abnormal time;

second memory means for storing plural numbers of the state indication data indicating the abnormal states of the frequency of the horizontal synchronizing signal and the frequency of the vertical synchronizing signal, and outputting the state indication data corresponding to the read-out signals;

display control means for outputting a video signal composed of horizontal and vertical synchronizing signals for operating the display and the state indication data supplied from the second memory means in response to the abnormal signal; and changing means for supplying a video signal supplied from the outside to the display at a normal time, changing the video signal from the outside to the video signal supplied from the display control means in response to the abnormal signal, and supplying the changed signal to the display.

2. A state indication circuit for a display which operates in a pair of a horizontal synchronizing signal of a frequency Ai (i=1 to N) and a vertical synchronizing signal of a frequency Bi, comprising:

first frequency-to-voltage conversion means for converting a frequency of a horizontal synchronizing signal supplied from an outside to a first voltage;

second frequency-to-voltage conversion means for converting a frequency of a vertical synchronizing signal supplied from the outside to a second voltage;

first analog-to-digital conversion means for converting the first voltage to corresponding first digital data;

second analog-to-digital conversion means for converting the second voltage to corresponding second digital data;

first memory means for storing digital data DHi and DVi corresponding to the frequencies Ai and Bi, respectively and digital data fi and gi corresponding to allowable variation values allowed for the operation of the CRT display as variation values of the frequencies Ai and Bi;

frequency decision means for deciding abnormality of the frequency of the horizontal synchronizing signal corresponding to the first digital data and the frequency of the vertical synchronizing signal corresponding to the second digital data by referring to the data stored in the first memory means, and generating abnormal signals corresponding to respective abnormal states; and indication means provided for the respective abnormal signals corresponding to the respective abnormal states and for indicating reception of signal in response to the respective abnormal signals.

* * * * *